United States Patent [19]

Hoch

[11] Patent Number: 4,864,821

[45] Date of Patent: Sep. 12, 1989

[54] METHOD AND APPARATUS FOR FILTERING SOLID PARTICULATE MATTER FROM DIESEL ENGINE EXHAUST

[75] Inventor: Robert Hoch, Middle Village, N.Y.

[73] Assignee: Brehk Ventures, New York, N.Y.

[21] Appl. No.: 51,231

[22] Filed: May 11, 1987

Related U.S. Application Data

[63] Continuation of Ser. No. 816,560, Jan. 6, 1986, abandoned.

[51] Int. Cl.[4] ..... F01N 3/02

[52] U.S. Cl. ..... 60/274; 60/279; 60/311

[58] Field of Search ..... 60/279, 274, 311

[56] References Cited

U.S. PATENT DOCUMENTS

| | | | |
|---|---|---|---|
| 3,100,376 | 8/1963 | Potter . | |
| 3,110,300 | 11/1963 | Brown . | |
| 3,503,714 | 3/1970 | 60 | 288/ |
| 3,645,098 | 2/1972 | Templin et al. . | |
| 3,798,878 | 3/1974 | Pausch . | |
| 3,868,237 | 2/1975 | Berz . | |
| 3,887,341 | 6/1975 | Sutter . | |
| 3,908,367 | 9/1975 | Bauman . | |
| 4,174,204 | 11/1979 | Chase . | |
| 4,316,360 | 2/1982 | Liu et al. . | |
| 4,338,784 | 7/1982 | Liu et al. . | |
| 4,343,631 | 8/1982 | Ciliberti . | |
| 4,345,429 | 8/1982 | Yasuhara . | |
| 4,355,504 | 10/1982 | Liu et al. . | |
| 4,380,900 | 4/1983 | Linder et al. . | |
| 4,398,931 | 8/1983 | Shevlin . | |
| 4,509,327 | 4/1985 | Enga . | |

FOREIGN PATENT DOCUMENTS

| | | | |
|---|---|---|---|
| 2521494 | 11/1975 | Fed. Rep. of Germany . | |
| 2833481 | 2/1980 | Fed. Rep. of Germany . | |
| 2946483 | 5/1981 | Fed. Rep. of Germany . | |
| 2339065 | 8/1977 | France . | |
| 55-51911 | 4/1980 | Japan . | |
| 59-79022 | 5/1984 | Japan . | |
| 37488 | 9/1984 | Japan | 60/279 |
| 59-165816 | 9/1984 | Japan . | |
| 1334472 | 10/1973 | United Kingdom . | |
| 2097283 | 11/1982 | United Kingdom | 60/279 |

OTHER PUBLICATIONS

An excerpt from a catalog of the Mott Metallurgical Corporation, Lachman et al. "Monolithic Honeycomb Supports for Catalysis", Jan. 1985.

Urban et al. "Diesel Car Particulate Control Methods" SAE Paper No. 830084, Mar. 1983.

Ullman et al. "Preliminary Particulate Trap Tests on a 2-Stroke Diesel Bust Engine" SAE Paper No. 840079, Mar. 1984.

Howitt et al. "Cellular Ceramic Diesel Particulate Filter" SAE Paper No. 810114, Feb. 1981.

*Primary Examiner*—Douglas Hart

*Attorney, Agent, or Firm*—Curtis, Morris & Safford

[57] ABSTRACT

An improved method for removing solid particulate matter from the exhaust of a diesel engine, having the steps of passing the engine's exhaust flow through at least a part of filter means to trap solid particulate matter contained initially in the exhaust, thereby to remove said matter from said exhaust flow, periodically interrupting the exhaust flow through at least said part of the filter means, passing, during said interruption, at least one backflush fluid pulse through at least said part of the filter means thereby to dislodge from the filter means, and entrain, said solid particulate matter, and transporting said dislodged solid particulate matter to the intake of said engine so that said matter can be combusted in the engine, wherein the improvement comprises purge means advantageously positioned so as to allow the discharge of noncombustible particulate matter from the engine before it accumulates to a harmful level.

15 Claims, 7 Drawing Sheets

RELATIVE QUANTITY w/NON-COMBUSTIBLES
ENTERING FILTER AMOUNT/ONCE-THRU AMOUNT

METHOD AND APPARATUS FOR FILTERING SOLID PARTICULATE MATTER FROM DIESEL ENGINE EXHAUST

This application is a continuation of application Ser. No. 816,560, filed Jan. 6, 1986, now abandoned.

FIELD OF THE INVENTION

The field of the instant invention is reduction of the emission level in diesel engine exhaust and, in a more specific vein, improved methods and apparatus for removal of solid particulate matter found in diesel engine exhaust.

BACKGROUND OF THE INVENTION

Over the past few years, the diesel engine has been relied upon increasingly to power automotive vehicles due to its fuel economy in comparison to conventional gasoline engines. Commercially available diesel engines for highway usage are conveniently classified into two categories, namely, those for use in light-duty vehicles and trucks, and those for use in heavy-duty vehicles. Light-duty vehicles and trucks are defined by the Environmental Protection Agency as passenger cars capable of seating twelve passengers or fewer, and light-duty trucks and all other vehicles under 8,501 pounds gross weight. This category includes most cars and pickup trucks, minivans, and some special purpose vehicles. Heavy-duty vehicles are defined as all vehicles over 8,500 pounds gross weight. Heavy-duty vehicles are, typically, trucks, buses, vans and recreational vehicles.

Additionally, the diesel engine finds application in industrial settings such as storage facilities and underground mines, many of which have only limited ventilation. And, diesel engines find further significant utilization in diesel locomotives; industrial applications such as fork lift engines, auxiliary engines on large vehicles, generator and pump service, and in logging, mining, shipping, quarrying and oil field operations, as well as well drilling equipment; construction applications, such as use in bulldozers, motor graders, tractors, scrapers, rollers and loaders; and agricultural applications, such as powering agricultural equipment.

However, despite its rising popularity, especially in the heavy-duty vehicle category, and although diesel engine exhaust (unlike that of gasoline engines) is relatively clean in respect of unburned hydrocarbon and carbon monoxide content, several significant difficulties are attendant upon use of the diesel engine. They stem essentially from the fact that diesel engine exhaust contains undesirably large amounts of solid particulate matter, for instance, in amounts at least thirty to fifty times greater than amounts present in the exhaust of a gasoline engine. This solid particulate comes not only from the carbonaceous byproducts of combustion (described in detail below), but also from sand, dust, and pollution present in the ambient air drawn into the engine by the intake. A further source of solid noncombustible particulate is minute pieces of the engine itself which are dislodged or broken off by the intense pressures and heat present in the operating engine. Noncombustible particulate is also present in the form of inorganic or hetero-organic components in the diesel fuel. These may be present in greater quantities than in high octane gasoline. Typically, they are sulfur compounds which can show up in the exhaust as sulfates. All of these noncombustible particulate byproducts normally become mixed with the other byproducts of combustion and are either ejected therewith through the engine's exhaust system or become entrained in the engine's oil filtration system.

Typical solid particulate matter from diesel engine exhaust is made up of small, solid, irregularly shaped particles which are agglomerates of roughly spherical subunits. The particles often have high molecular weight hydrocarbons absorbed on their surfaces, and also may have a liquid coating; frequently, the particulate matter is a complex mixture of pure carbon and hundreds of organic compounds. The particulate is often extremely fine and light with a flour-like consistency. Size distribution ranges from very small single particles of about 0.01 microns to relatively large clusters in the range of 10–30 microns. Illustratively, the particles have a bulk density of 0.075 g/cm$^3$ and have a surface area of 100 m$^2$/g. Generally speaking, the nature of solid particulate matter emitted from turbocharged diesel engines is somewhat different from that of naturally aspirated diesel engines, the former tending to be smaller in size with much lower levels of retained organic compounds.

Unchecked, the aforementioned high level of solid particulate emission in diesel exhaust will continue to compound problems caused by the already high levels of total suspended particulates in the atmosphere, especially in urban areas. For example, as the diesel population increases it can be expected that there will be a decrease in visibility in major cities. Thus, the National Research Council estimates visibility loss in 1990 to be twenty percent in Los Angeles and fifty percent in Denver (*Science,* page 268, January 1982). Moreover, certain characteristic components of diesel exhaust particulate emissions have been identified as carcinogens; their presence in the atmosphere thus creates an evident and unacceptable health hazard. In this connection, the National Cancer Institute has published a study which showed that truck drivers operating diesel vehicles ran a risk of suffering bladder cancer up to twelve times that of the normal population (*Wall Street Journal,* Apr. 11, 1983).

Responding to the above-described situation, the Environmental Protection Agency has proposed a standard for particulate matter emission from diesel powered light-duty vehicles of 0.6 g/mile, beginning with the 1987 model year; the agency has further proposed (for enforcement beginning with the 1990 model year) a standard for such emissions from diesel powered heavy-duty vehicles of 0.25 g/bhp-hr (brake horsepower hour).

One of the options which is available to manufacturers of diesel engines and automotive vehicles for combating the aforementioned problem is deliberate suppression of power output in commercially produced diesel engines. Indeed, this technique is simply an extension of methods used to control smoke and gaseous emissions as previously used by engine manufacturers. Specific examples of such technique are the methods used to minimize (1) acceleration smoke and (2) lugdown smoke.

Acceleration smoke is that generated during vehicle acceleration. It is caused by a higher-than-desired fuel/air ratio and usually manifests itself as a short duration, black puff. Lugdown smoke is generated during operation under a heavy load, for instance, during hill climbing. It can conveniently be considered as full load, steady state smoke. Manufacturers compensate for these difficulties by mechanically limiting the amount of fuel injected under conditions at which the emissions are generated. Thus, smoke reduction is promoted at the cost of lost performance.

By the foregoing technique, engine manufacturers have made some headway in the endeavor to cut back the solid particulate emissions in the exhaust of such engines. But, although these methods have been somewhat helpful, they are not an adequate solution. That is, the aforementioned expedients are not effective to eliminate all solid particulate emission or even to decrease it to a desirably low level, unless power output is reduced to an unacceptably low level.

Several alternative possibilities for reducing emission levels have been investigated. Prominent among those possibilities are thermal and catalytic oxidation of particulate while it is still suspended in the exhaust stream, thermal oxidation of filter-trapped particulate matter, and catalytic oxidation of filter-trapped particulate matter. However, these possibilities generally have associated shortcomings which detract from their suitability as viable commercial solutions.

For example, thermal instream oxidation techniques require the provision to the exhaust stream of large amounts of heat energy which is typically unrecoverable. Catalytic instream oxidation requires devising a suitable means for introducing catalyst material into the exhaust stream, and preliminarily, identification of appropriate catalysts, both difficult problems which to date have defied solution.

Other of the aforementioned possibilities involve use of a filter to remove solid particulate from a diesel engine exhaust stream. Use of filters has generated a relatively large amount of interest in the art. Experimentation has been conducted with a number of different types of filter materials, notably ceramic materials, stainless steel wire mesh, and the like. Filtration is, of course, a reasonably direct manner in which to remove particulate emission from an exhaust stream. However, because of the quantities of particulate generated, use of filters is accompanied by significant difficulties resulting from the tendency of those filters to clog, block or bind.

For many systems (filter media/particulate) loading is an irreversible process insofar as once loading or clogging has reached a certain point, the filter element must be discarded and replaced since the initial condition cannot be restored; for such filter elements, cleaning is ineffective.

An additional problem specific to the use of a filter to collect diesel particulate stems from the obvious need to locate the filter in the engine exhaust line. Diesel engine performance is sensitive to the pressure drop in this exhaust system. While the pressure drop through a clean filter may be acceptable, clogging, even if not allowed to proceed to irreversibility, leads to choking off of the exhaust flow through the filter. Filter clogging thus tends to increase the pressure differential across the filter element and impede the exhaust operation. Accordingly, it is necessary, if filtration is to be a practical solution, to remove solid particulate matter which clogs exhaust flow filtering elements, i.e., regenerate the filter.

It is not surprising, therefore, that filter regeneration is central to many of the above-mentioned filtration techniques. But, while they address filter regeneration, those techniques do not make it commercially attractive. For example, thermal and catalytic oxidation of filter-trapped particulate matter to regenerate the filter is problematical inasmuch as the space, cost, and energy consumption requirements which accompany them are substantial. These filtration techniques are no more acceptable than the direct, instream oxidation techniques which do not make use of filters.

As an indication of the direction the art has taken, see a recent survey and evaluation of the above-discussed proposals—Murphy et al., "Assessment of Diesel Particulate Control - Direct and Catalytic Oxidation," presented at the International Congress and Exposition, Cobo Hall, Detroit, Mich. (Feb. 23–27, 1981), SAE Technical Paper Series, No. 810,112—in which it is stated that the technique apparently holding greatest promise for removal of solid particulate matter from diesel engine exhaust is catalytic oxidation of filter-trapped particulate matter.

Another proposal for removal of solid particulate matter from diesel engine exhaust appears in U.K. Pat. Application No. 2,097,283. That application discloses a method for filtration of exhaust flow, and corresponding apparatus, which involves use of ceramic filter material and no less than two filter zones which are alternately employed for filtering the exhaust stream of an internal combustion engine. The essence of that technique is the filtration of the exhaust stream with one filter zone while simultaneously regenerating the other filter zone by passing an appropriate fluid (e.g., air) through it, in a direction opposed to that of exhaust flow, in order to dislodge trapped solid particulate matter. That regeneration technique is known as backflushing. No quantification of backflushing time is given; it is apparent that backflushing is effected by continuous, relatively long term passage of backflushing fluid through the filter zone being regenerated. The solid particulate matter removed from the filter is recycled to the engine for incineration. At a desired time the regenerated filter zone is inserted in the exhaust stream and the other filter zone is subjected to backflushing. In this manner, the filter zones are periodically rotated in an attempt to maintain effective engine operation during filtering.

However, even the technique described in the above-identified U.K. Patent Application has significant drawbacks. Use of the continuous backflushing procedure which the application prescribes is ineffective to prevent long term clogging of the filter zones employed. Rather, despite backflushing, that clogging steadily increases, and results in a steadily increasing pressure drop across the filter. Steady-state operation cannot be achieved. Furthermore, although with the continuous backflushing/recycling procedure prescribed in the U.K. Patent Application the particulate emission level is somewhat lower, that level is still undesirably high—leaving much room for improvement.

A further serious problem which was not discussed in the above-identified U.K. Patent Application is that of accumulation of noncombustible particulate both at the exhaust-filter interface and within the intake-exhaust system. As discussed above, both normally aspirated and turbocharged diesel engines produce a certain amount of noncombustible solid particulate as byproducts of combustion. These byproducts are created as a result of normal engine decay and through the ingestion of atmospheric particulate such as sand and dust through the air intake. Non-hydrocarbons contained in the fuel provide a third, perhaps the greatest, source of noncombustible materials.

Depending upon engine/regeneration system type and condition, as well as fuel and ambient air quality, as much as one-third of the solid particulates may be noncombustible. Thus an inherent problem with the closed filtered exhaust system as shown in the U.K. Patent Application is that, unless purged, this noncombustible solid particulate will accumulate at a steady rate within the system until it actually shuts down the engine or damages it beyond repair.

Even if this amount of noncombustible particulate represents a relatively small percentage of the overall production of exhaust particulate, it will, if allowed to accumulate over long periods of time, become a major constituent of the entrapped particulate and will reduce trap capacity and cause serious damage to the engine, since it is continually being reintroduced into the combustion chamber with the other byproducts of combustion. This continuous reintroduction causes such deleterious effects as scoring of cylinder walls, destruction of piston rings, etc., and would overshadow the benefits of such an emission control system.

OBJECTS OF THE INVENTION

It is an object of the instant invention to provide an improved method of removing solid particulate matter from the exhaust of a diesel engine which enables increased utilization of the power output potential of that engine with a simultaneous reduction of solid particulate emission to an insignificant level and effectively maintain accumulated noncombustible particulate at a safe level, and also to provide apparatus for accomplishing same.

It is another object of this invention to provide an improved method for removal of both combustible and noncombustible solid particulate matter from diesel engine exhaust which is direct, simple, relatively inexpensive and highly efficient, as well as to provide apparatus for accomplishing same.

It is yet another object of the instant invention to provide an improved method for filtration-removal of solid particulate matter from diesel engine exhaust which is effective to regenerate the filter material substantially completely and thereby restore an acceptably low pressure drop across it, as well as to provide apparatus for accomplishing same.

It is still another object of this invention to provide an improved method for filtration-removal of solid particulate matter from diesel engine exhaust which is effective in increasing the efficiency of combustion of recycled solid particulate emission thereby—in combination - with filtration of the exhaust stream—to decrease solid particulate levels in diesel engine exhaust synergistically.

It is a further object of this invention to provide an improved method for achieving a steady state level for noncombustible solid particulate within a diesel engine, as well as to provide apparatus for accomplishing same.

STATEMENT AND ADVANTAGES OF THE INVENTION

The objects of the instant invention are achieved as follows.

In one of its aspects, the present invention is in an improved method for removing solid particulate matter from the exhaust of a diesel engine, wherein the steps of (1) passing the engine's exhaust flow through at least a part of a filter means to trap solid particulate matter in the exhaust, thereby to remove said matter from said exhaust flow; (2) periodically interrupting the exhaust flow to at least said part of the filter means; (3) during said interruption passing a backflush fluid pulse through said filter means to effect dislodgment of said solid particulate matter from said part of said filter means; and (4) transporting said dislodged solid particulate matter to the intake of said engine so that said matter can be combusted in the engine; are combined with the further step of periodically purging the exhaust system to allow the accumulated noncombustible solid particulate to be removed from the engine.

In another of its aspects, the present invention resides in improved apparatus, in a diesel engine, for decreasing exhaust emission, having filter means which is positioned to intercept the engine's exhaust flow and which traps solid particulate matter in the exhaust when that exhaust flows through at least a part of said filter means, thereby to remove said matter from said exhaust flow; means for periodically interrupting the exhaust flow through at least said part of the filter means; means for passing, during said interruption, a backflush fluid pulse through the filter means to effect dislodgment of said solid particulate matter from said part of the filter means; and means for transporting said dislodged solid particulate matter to the intake of said engine so that said matter can be combusted in the engine; wherein purging means is added to periodically remove the accumulated noncombustible solid particulate from the engine.

In a further aspect, the invention is in an improved method for removing solid particulate matter from the exhaust of a diesel engine, which comprises the steps of (1) passing the engine's exhaust flow through filter means containing (a) a single filter zone to trap in the filter zone solid particulate matter in the exhaust, thereby to remove said matter from the exhaust flow and (b) at least one unobstructed passage through or around said filter means, sized relative to said filter means to permit a portion of the total exhaust flow to avoid said filter; (2) periodically interrupting the exhaust flow through said filter zone; (3) during said interruption, passing through said filter zone a backflush fluid pulse sufficient to effect dislodgment of said solid particulate matter from the filter means; and (4) transporting said dislodged solid particulate matter to the intake of said engine so that said matter can be combusted in the engine.

In yet another of its aspects, the invention is in apparatus, in a diesel engine, for decreasing exhaust emission, which comprises filter means having a single filter zone which is positioned to intercept the exhaust flow of said engine and which traps solid particulate matter in the exhaust of said engine when that exhaust flows through said filter zone, thereby to remove said matter from the exhaust flow, said filter means having at least one unobstructed passage through or around said filter means, sized relative to said filter means to permit a portion of the total exhaust flow to avoid said filter zone and be removed from said engine; means for periodically interrupting the exhaust flow through said filter zone; means for passing, during said interruption, through said filter zone a backflush fluid pulse sufficient to effect dislodgment of said solid particulate matter from the filter means; and means for transporting said dislodged solid particulate matter to the intake of said engine so that said matter can be combusted in the engine.

Numerous advantages accrue to the practitioner of the instant invention. The present improved method and apparatus embodiments result in a reduction of solid particulate emission levels in diesel engine exhaust to an insignificant level; generally, 90% or more of the solid particulate emissions are removed, and particulate emissions are well under maximum emission levels proposed for implementation in the foreseeable future. The noncombustible solid particulate is either continually or periodically being removed by the purging means to achieve a substantially steady state condition wherein the percentage of the noncombustible particulate is maintained at an acceptable level. This obviates the need to suppress potential power output of the engine in order to reduce emission levels; hence, a significantly increased utilization of the diesel engine's potential power output is enabled. Furthermore, the present invention provides a method and apparatus for controlling solid particulate emission which are direct, simple, relatively inexpensive and efficient through the use of widely available filtration materials and the elimination of the need to introduce large amounts of thermal energy, catalytic agents and the like into the filtering system. Additionally, the present invention, through employment of pulsed backflushing, effects a substantially complete regeneration of the filter material utilized. This confers a significant benefit inasmuch as steady deterioration of the filter material due to irremediable long term clogging effects, experienced when employing continuous backflushing, is eliminated and high filtration efficiency is maintained (thereby improving in-use performance and prolonging life expectancy of the filter). Also, and significantly, the present invention's employment of pulsed backflushing to regenerate the filter material, and the concomitant recycling of trapped solid particulate matter to the engine for combustion, actually result in a synergistic increase in the efficiency of incineration of that solid particulate matter vis-a-vis the efficiency of incineration of recycled solid particulate emissions when employing continuous backflushing. The purging of the noncombustible solid particulate advantageously serves to protect vital engine components such as turbochargers and cylinder walls from excessive wear and premature failure while negligibly affecting overall emissions from the engine. The instant invention is, therefore, a substantial technical and commercial advance.

In the following sections, the invention is described in greater detail to illustrate several of its preferred embodiments.

DESCRIPTION OF CERTAIN PREFERRED EMBODIMENTS

Figure 1:
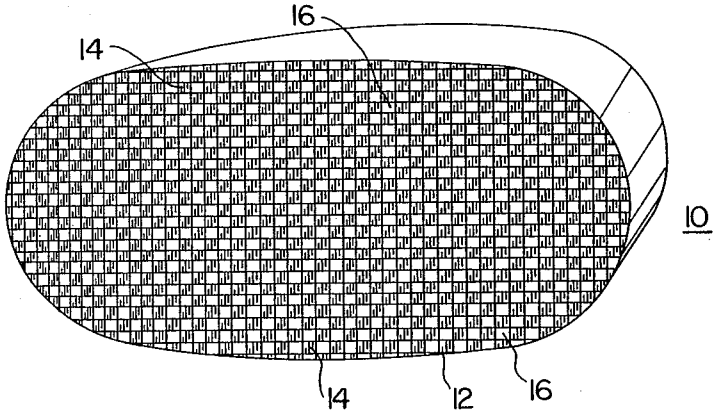
FIG. 1 is a perspective view of a "ceramic honeycomb" filter element suitable for practicing the invention.

The present invention is suitable for use in conjunction with both naturally aspirated and turbocharged diesel engines of all sizes, but particularly with larger turbocharged diesel engines utilized in heavy-duty vehicles, such as trucks, buses and the like, or in heavy industrial applications of the sort in which solid particulate emissions are especially high and especially intolerable due to poor ventilation or the like.

The principal criterion of success with the present invention (as with all regenerative filtering systems for combustion engine emission) is the attainment of the desired radical minimization of solid particulate emission levels while avoiding accumulation of high levels of noncombustible solid particulate in the system under conditions of steady state operation conducive to commercial, automotive and other industrial applications. Put another way, filtering methods and apparatus which involve a filter element that irreversibly (even if gradually) clogs to a level beyond that at which the filtration is compatible with effective engine operation, or the utilization of which result in the collection of solid particulate emissions elsewhere in the system until efficient operation of the engine is foreclosed, are not capable of sufficiently long term operation to make them feasible solutions to the pollution problems discussed hereinabove. By way of example, those of ordinary skill in the art can readily appreciate that particulate emission clogging of a filter element or trap will result in an unworkably large increase in pressure differential across the trap, thereby introducing into the system an unacceptably high back pressure so as to impede the operation of the engine itself. Accordingly, the desideratum is to achieve equilibrium, i.e., a condition in which the amount of particulate emission from the engine is equivalent to an amount which is disposed of in a manner minimizing atmospheric pollution to the greatest degree possible. Pollution minimization in accordance with the instant invention is accomplished by returning the solid particulate matter (except for the amount which remains in the system itself) to the engine for combustion (incineration). Hence, design choices made in the course of implementing utilization of the invention will be geared toward maintaining the particulate emission inventory in the system at a feasibly low level and maximizing the amount of particulate emissions returned to the engine and there incinerated. At designated intervals the system will be purged in order to maintain a safe level of accumulated noncombustible solid particulate and avoid excessive engine wear and premature failure. This purging also prevents the filtering zone from becoming clogged with noncombustible solid particulate which accumulates as it continually passes through the engine without being destroyed.

One important point to consider is the filter element or trap which is utilized to remove solid particulate matter from the exhaust stream emitted by the engine. Suitable materials for filtering the exhaust stream in accordance with the invention are ceramic honeycomb, sintered metal particles, coated and uncoated metal mesh, ceramic fiber, ceramic foam, fiberglass, and packed beds. Of these, ceramic honeycomb and sintered metal particle materials act as surface filters inasmuch as particles larger than the effective pore size of the honeycomb are normally collected on its upstream surface. In contrast, the other four filter media can be considered to function as depth filters because particle removal is not limited to the surface, but is continuous throughout part or all of the filter material's thickness or depth.

In a ceramic honeycomb filter solid particles larger than the approximate mean pore size of the material are intercepted at the material's surface and prevented from passing through the material. As particles collect on the surface, the effective pore size is reduced which, in turn, leads to an increased efficiency as smaller sized particles are collected. In general, ceramic honeycomb traps have three zones of activity: first, a period of relatively rapid back pressure increase, most likely resulting from early pore plugging and initial cake formation on the upstream surface of the filter material; second, a prolonged period characterized by a relatively constant loading slope; finally, a shorter period during which back pressure again increases rapidly, probably due to complete plugging of many cells. Illustratively, the leading one inch or so of the filter material, when used in a typical filter assembly (see FIG. 1 or 2, described hereinafter) usually becomes more heavily loaded than does the remainder of the filter which carries only a lighter and relatively uniform film of the solid particulate filtrate. Dislodgment of trapped solid particulate matter in accordance with the invention is preferably accomplished in the first or early second stage. However, design of the ceramic honeycomb filter to optimize air flow within each channel of that filter element in order to distribute the loading more evenly does, in certain embodiments, increase the effectiveness of dislodgment and/or the time period which can be permitted to elapse between dislodgment events.

In certain embodiments of the present invention, this ceramic honeycomb filter is provided with at least one unobstructed passage from the upstream side of the filter to the downstream side. The size of this passage is designed so that between 0.2% and 70% of the exhaust passing through the filter is allowed to "bleed off" and pass, unfiltered, out of the system. By advantageously sizing the passage, a substantially uniform, steady state condition is realized wherein the percentage of accumulated noncombustible solid particulate will rise to a certain limit and remain. Since a uniform volume of exhaust gas is allowed to bleed off continuously, an equilibrium will be achieved, at which point the percentage of accumulated noncombustible solid particulate in the escaping volume will be equal to that produced by the engine.

Sintered porous metal filter materials are advantageous in that they exhibit the structural integrity, corrosion resistance and temperature resistance required in certain embodiments of the invention. These materials are made typically by precompacting and then sintering stainless steel, nickel-base and other types of alloy metal powders. They are commercially available—for instance, from Mott Metallurgical Corporation—and are well adapted to regeneration (i.e., cleaning) in accordance with the present invention. Their "reentrainment" characteristics can be highly useful in removing trapped particles with a relative minimum of difficulty. A sized passage as described above may also be employed with this filtering material in certain embodiments of the present invention.

In both wire mesh and ceramic fiber filter materials, the primary trapping mechanisms are impaction and diffusion. That is, during operation larger particles collide with the filaments of the mesh or fiber material and adhere to filament surfaces, or to particles already collected on those surfaces. Additionally, some smaller particles migrate by diffusion to the surface of the mesh or fiber material or to previously collected particles, and are also retained in the filter. Mesh and fiber traps of this sort are advantageous in that the back pressures attendant upon their use are relatively low. While their tendency to exhibit a "blowoff" phenomena—that is, a reentrainment in the exhaust stream of previously collected particles—can be somewhat disadvantageous, its controlled occurrence operates, in certain embodiments of the present invention, to the advantage of the invention's practitioner as controlled reentrainment is one of the objects of the invention. In an alternative embodiment, metal mesh filter material is coated with activated alumina which provides a highly porous surface structure of large surface area. Additionally, the porous surface tends to disrupt boundary layer flow thereby encouraging diffusion to the mesh filament. The foregoing result in increased collection efficiency and holding power.

Ceramic foam filter materials, such as silica foam materials, are also useful. These materials provide a three-dimensional, open pore network which collects solid particulate matter efficiently. The main trapping mechanisms are interception and diffusion. In general, trapping efficiency increases as the number of cells per linear inch and depth increases. Pressure drop across the ceramic foam filter increases with cell number and depth, but substantially decreases with increasing cross-sectional area for a given volumetric flow rate. This problem, however, is nonexistent in embodiments of the present invention employing an unobstructed passage through the filter means, since, as the filter material becomes blocked, more and more of the exhaust will be forced through the passage and out of the system. Dislodgment of trapped particles in accordance with the present invention is, in many instances, more difficult when employing a ceramic foam material; however, in some embodiments, this difficulty is more than offset by the decreased back pressure attendant upon use of ceramic foam material in comparison with ceramic honeycomb material, due to the fact that cell size in the ceramic foam materials is often larger than the pore size in ceramic honeycomb structures.

Granular bed filters lend themselves to practicing of certain embodiments of the invention. They are particularly interesting for their capacity to function either in a stationary or fluidized mode. It follows that the granular bed can be operated in a stationary mode during loading or trapping to enhance collection efficiency, and then be operated in a fluidized mode during cleaning to enhance dislodgment and reentrainment. This benefit is a result of the fact that penetration in a moving bed is usually significantly higher than penetration in an otherwise equivalent stationary bed, the increase being attributable to better reentrainment through mechanical agitation in the fluidized mode. In an advantageous embodiment, collection efficiency of a stationary granular bed is increased by the intergranular deposits in the bed, that is solid particles which become interstitially lodged during filtering; the bed operates as a graded media filter, larger particles typically being collected on granules at the bed's surface and smaller particles collected within the bed's pores by an increasingly dense deposit. Shallow beds are favored because they can be designed to provide high collection efficiency with relatively low back pressure and easy dislodgment and reentrainment.

An especially preferred filter material is a ceramic honeycomb unit with parallel channels running its entire length. The cells are advantageously square in shape, but are suitably otherwise configured to be circular, elliptical, etc. The ceramic filter unit is suitably fabricated of a porous cordierite ($2MgO\text{-}2Al_2O_3\text{-}5SiO_2$), but is also acceptably made of any other ceramics, such as mullite, alumina, forsterite, aluminum titanate, mullite and aluminum titanate, spinel, zirconia and spinel, calcia, partially stabilized zirconia, and alumina and silica. Units fabricated of the foregoing materials which are suitable for the invention typically have physical features such as cell density porosity , mean pore size, coefficient of thermal expansion and compression strength corresponding to those of commercially available units of such materials employed in filtering particulate from diesel engine exhaust. The overriding requirements are that the material has the necessary mechanical strength, chemical resistance, thermofracture resistance, and melt resistance to survive effectively in the hostile environment presented by diesel engine exhaust.

In FIG. 1 there is depicted one type of ceramic honeycomb filter unit suitable for practicing of one embodiment of the present invention. The unit 10 has a monolith face 12. On the face, openings 14 alternate with solid ceramic plugs 16 to form a checkerboard arrangement. The openings permit ingress to and egress from parallel channels which extend the entire length of the unit. The channels terminate at the opposite end of the unit (not shown), and are blocked at that end by ceramic plugs so as to create a set of blind passages. The opposite end of the filter unit is also made up of alternating pores and ceramic plugs. The pores in the opposite end permit ingress to and egress from a corresponding parallel set of channels running the entire length of the unit and terminating in ceramic plugs 16 in face 12. Thus the ceramic channels opening at the opposite end of the filter unit 10 provide another set of parallel blind passages, and are situated in the filter unit to alternate with the blind passages which open on face 12.

Figure 1A:
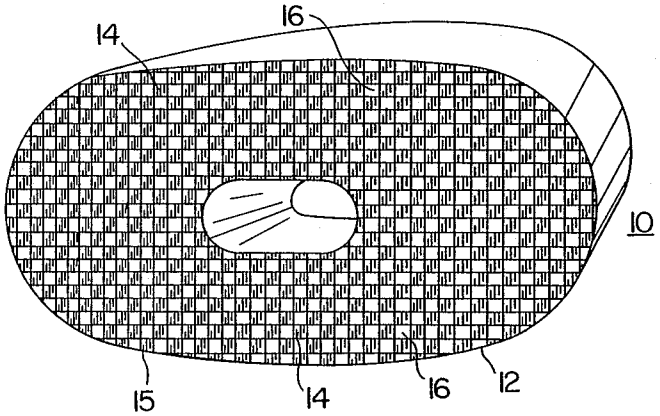
FIG. 1A is a perspective view of a similar "ceramic honeycomb" filter as in FIG. 1 but with an unobstructed passage therethrough.

FIG. 1A depicts a similar ceramic honeycomb filter unit to that described above having an unobstructed passage 15 extending the entire length therethrough which is advantageously sized relative to the filter to permit from 0.2% to 70% of the exhaust to bypass the filtering means. This passage is advantageously elliptical in shape. However, it may be formed in any desired shape. Further, the size and number of unobstructed passages may be varied to accommodate different design characteristics, flow patterns or exhaust turbulence.

Figure 2:
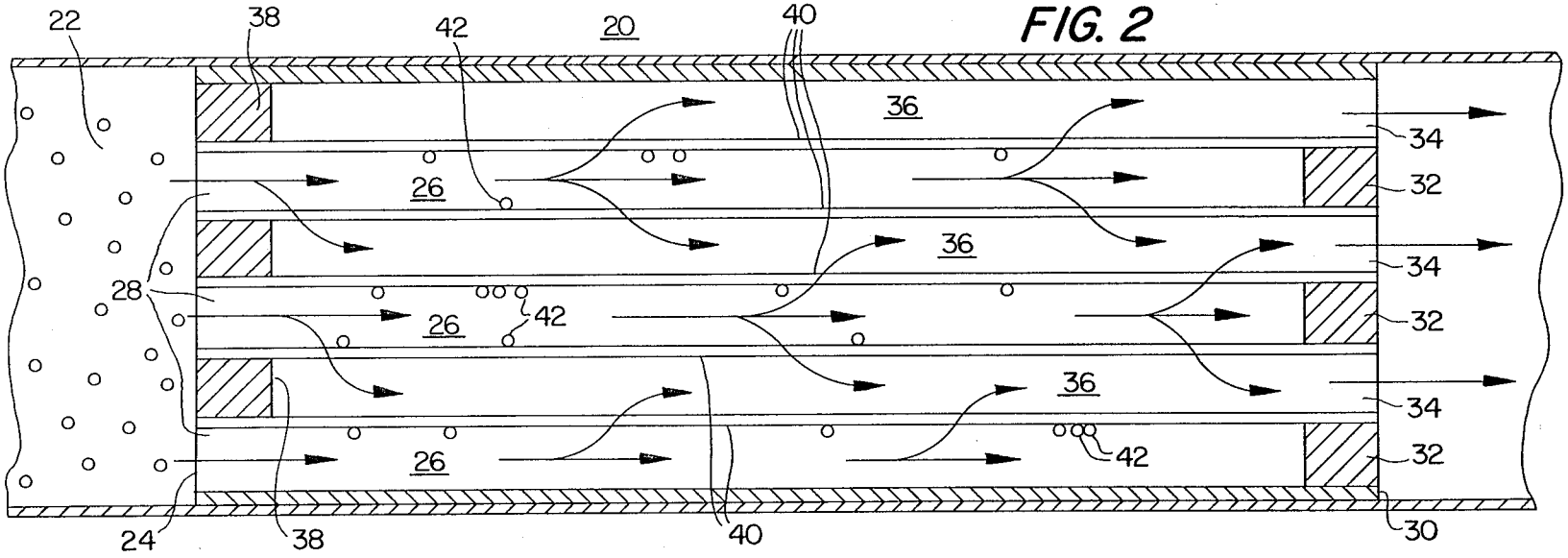
FIG. 2 is a schematic view of several individual passages within the filter element of FIG. 1.

FIG. 2 schematically depicts channel arrangement 20 of the type shown in FIG. 1. Particulate-laden exhaust 22 is directed at the upstream face of the unit 24. The exhaust enters blind channels 26 through openings 28 in the upstream face of the unit. Channels 26 are blocked at the downstream face 30 by ceramic plugs 32. At the downstream face 30, openings 34 permit ingress to and egress from channels 36. Those channels are closed at the upstream face 24 by ceramic plugs 38. Channels 26 and 36 are separated by common walls 40. These common walls are sufficiently porous to permit passage of exhaust gas; however, the wall pores are sufficiently small to prevent passage of the vast majority of solid particulate matter in the exhaust. Thus, as can be seen from the arrows in FIG. 2, exhaust gas carrying solid particulate matter enters openings 28 and passes along channels 26. Solid particles 42 are trapped on the walls of the channels 26 while the gas passes through the porous walls and proceeds along channel 36 to openings 34 where it is released downstream of the filter unit. Plugs 38 at the upstream face 24 of the filter unit prevent passage of the particulate laden exhaust into channels 36 directly. Correspondingly, plugs 32 prevent escape of particulate laden exhaust at the downstream face 30 of the unit.

Figure 2A:
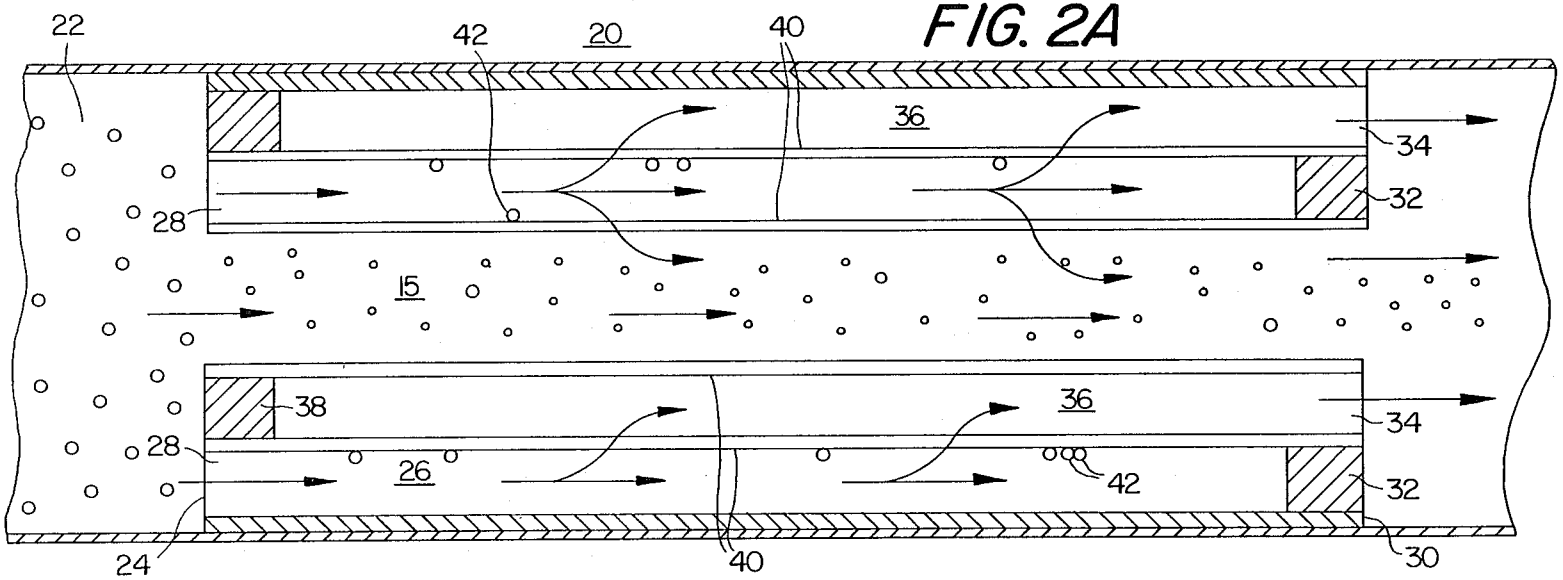
FIG. 2A is a schematic view of the unobstructed passage in FIG. 1A and the individual filtered passages.

FIG. 2A is a schematic side view of the ceramic filter element in FIG. 1A showing the unobstructed passage 15 extending from the upstream face 24 to the downstream face 30 for allowing a predetermined percentage of the exhaust gases 22 to pass unobstructed through the filter 10. The balance of the filter operates using the same principles as those described above. The exhaust gas 22 which does not exit through passage 15 enters blind channels 26 through openings 28 in the upstream face of the unit. These channels 26 are blocked at their downstream face 30 by ceramic plugs 32. The particulate-laden exhaust is then forced through the porous common walls 40 into adjacent passages 36 by the pressure of the exhaust. The entrained particulate 42 is trapped at the surface of the walls 40 as the gas passes therethrough.

In order to clean the filter units depicted in FIGS. 1, 1A, 2 and 2A, a backflush fluid pulse is passed through such unit in a direction opposite that of the aforementioned exhaust. Thus, the backflush fluid pulse first encounters what is normally downstream end 30 of the unit, passes through openings 34 and into channels 36, diffuses through common walls 40, dislodges particles 42 from the common walls in channels 26, entrains those particles and carries them along channels 26 through openings 28 and out of the trap. In this manner, the trap is cleaned, that is regenerated.

In certain preferred embodiments of the invention, particularly its application to automotive uses, the collection efficiency of the trap must be balanced against, and not accomplished at the expense of, excessive introduction of back pressure in the exhaust system. In such cases, it is advantageous to design the trap, the purge means and associated exhaust system to maintain back pressure at as low a level as possible. Relatedly, the time period allowed to elapse between filter unit cleanings must not be so great as to permit the accumulation of a layer of solid particulate matter on the filter material surface so as to increase the pressure drop to an unacceptable level. As is readily understood by those of ordinary skill in the art, increasing the pressure drop across the closed filter unit is accompanied by increasing back pressure in the exhaust system. Backpressure has a direct and detrimental effect on the operation of the engine, and its occurrence should be minimized whenever possible. Pressure drop can be maintained at lower levels through the choice of appropriate design features such as the incorporation of unobstructed passages previously described. Illustratively, it is a function of cell geometry, wall properties and volume of a ceramic filter unit. Those features are advantageously set such that a balance is struck between minimizing pressure drop and maintaining the required filter efficiency.

It is important to note that practicing of the instant invention frees the skilled artisan from filter design constraints which would otherwise be imposed upon him due to the use of conventional regeneration techniques. More specifically, in regenerating processes which involve burning of soot and other solid particulate matter trapped in the filter unit, the filter must be configured in order to obtain regeneration times and peak pressures which fit within desired ranges for engine and/or environmental requirements. Furthermore, in automotive applications the filter material must exhibit structural integrity for the useful lifetime of the vehicle.

Burning collected soot off the filter places a greater physical demand on the filter than the conditions it is normally subjected to in the course of filtering exhaust. That is to say, burning of accumulated soot and other solid particulate matter during regeneration releases a large amount of energy and generates a rapid temperature rise. Moreover, that temperature rise is not necessarily evenly distributed throughout the filter unit, thereby setting up thermal gradients in both radial and axial directions. Additionally, excessive buildup of solid particulate matter can result in release of an excessively large amount of energy upon burning, thus subjecting the material (e.g. ceramic material) of the filter unit to temperatures exceeding its melting point. The quest for achievement of acceptable operating characteristics and filter life using certain conventional regeneration processing is prohibitively impeded, if not defeated, by the necessity to strike a balance among the competing considerations of filtration time between regeneration cycles, filter pressure drop, and degree of particulate loading.

Of course, since with the instant invention regeneration is accomplished without the use of ignition of trapped solid particulate matter in the filter unit, the foregoing problems are eliminated. Attainment of the stated objective of providing an improved method and apparatus for removal of solid particulate matter from diesel engine exhaust which are direct, simple, relatively inexpensive and highly efficient is manifest.

In a closed filter embodiment (for example, FIGS. 3, 4 or 5), once trapped by the filter unit during exhaust flow therethrough, solid particulate matter is advantageously removed from the filter by passing a pulse of backflush fluid through the filter unit in a direction opposite to that of the exhaust flow. The concept of pulsation is understood in the art, and normally refers to the generation of one or more impulses or surges of fluid having sufficiently great power so that when the impulse or surge strikes and passes through the filter unit the particles residing in the trap are dislodged. It is a concomitant advantage of utilizing a backflush fluid pulse that the fluid also serves as a medium in which dislodged particles are entrained and carried back to the engine for incineration. Accordingly, in order for particle dislodgment to be carried out successfully in order to reduce system backpressure and renew filter efficiency, the separation forces exerted by pulsed backflush fluid must be in excess of the forces by which solid particulate matter adheres to the filter material. In addition to any direct mechanical forces that might result from flow reversal (depending on the filter material), movement of the backflush fluid stream in the immediate vicinity of trapped particulate matter is significant. Generally, in order to initiate particle movement the particle must receive energy from an external source, for instance from the impact of another particle or object or from drag forces of the moving backflush fluid stream past the exposed profile of the particle. A convenient way of looking at this phenomenon is that the backflush fluid pulse must be composed of a sufficient amount of fluid colliding with and passing through the filter unit at a sufficient velocity to dislodge trapped particles. Alternatively, the pulse can be viewed as a wave; the pulsed backflushing must be of sufficient power (i.e. a sufficient amount of energy must pass by some point in the filter per unit time) to dislodge trapped particles. Yet another way of conceptualizing this phenomenon is that the change in pressure at any one point in the filter unit due to the passage of the wave therethrough should occur in an amount of time which is sufficiently short that the fluid pulse is capable of dislodging trapped particles. It can, of course, be readily appreciated by those of ordinary skill in the art that the minimum requirements for the backflush fluid pulse to be effective in dislodging particles will vary from system to system and filter unit to filter unit depending on size, configuration and the like. However, equipped with the teachings of this application, and knowledgeable of the parameters and dimensions of his particular system, the skilled artisan will be able to determine—whatever his characterization of the parameters defining the pulse—without undue experimentation the extent and magnitude of pulsed backflushing necessary to practice the instant invention. This determination is discussed in detail below in regard to FIGS. 6A–C.

Figure 3:
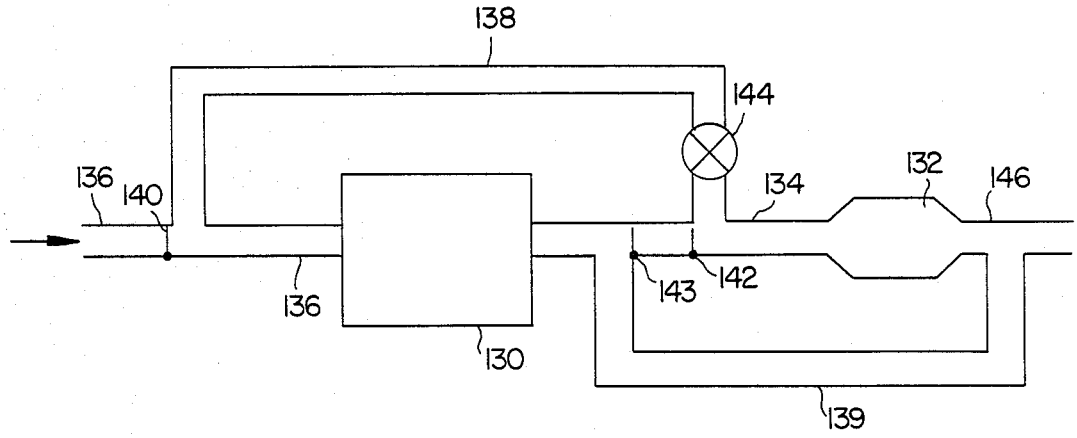
FIG. 3 is a schematic view of one embodiment in accordance with the present invention employing a filter bypass.
Figure 3A:
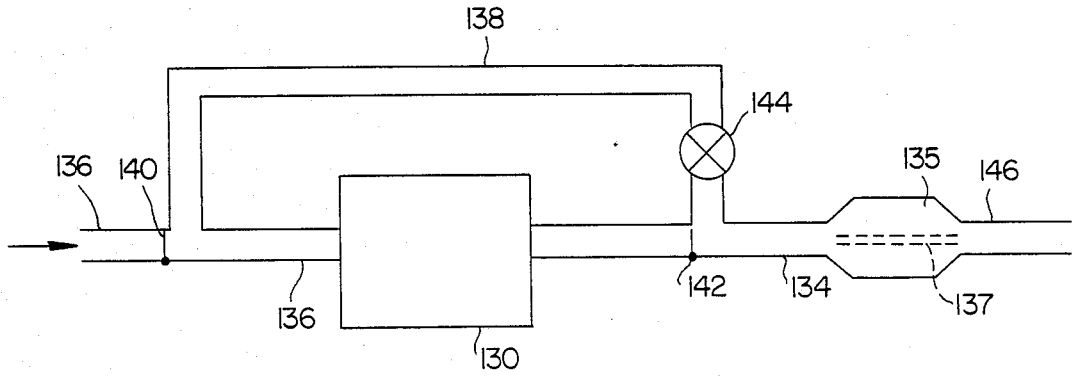
FIG. 3A is a schematic view of another embodiment in accordance with the present invention employing the filter having an unobstructed passage shown in FIGS. 1A and 2A.
Figure 4:
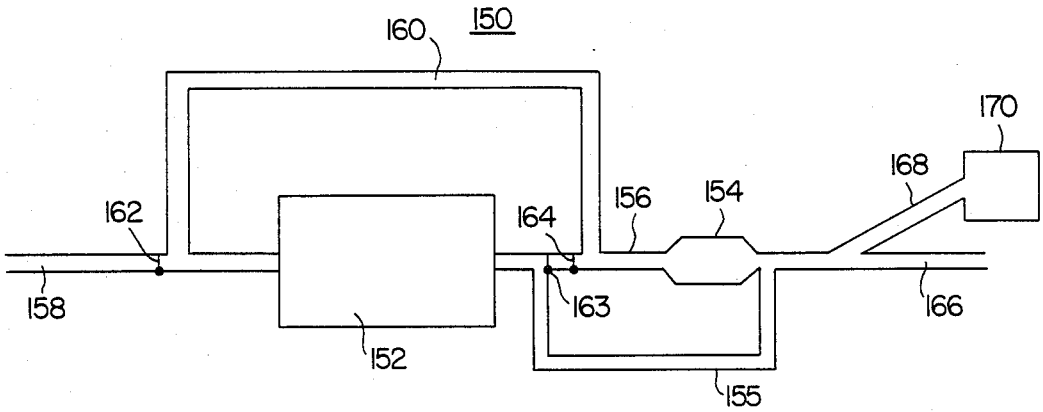
FIG. 4 is a schematic illustration of an alternative embodiment of the present invention employing the filter bypass in which pulsed backflushing is carried out with compressed air.
Figure 4A:
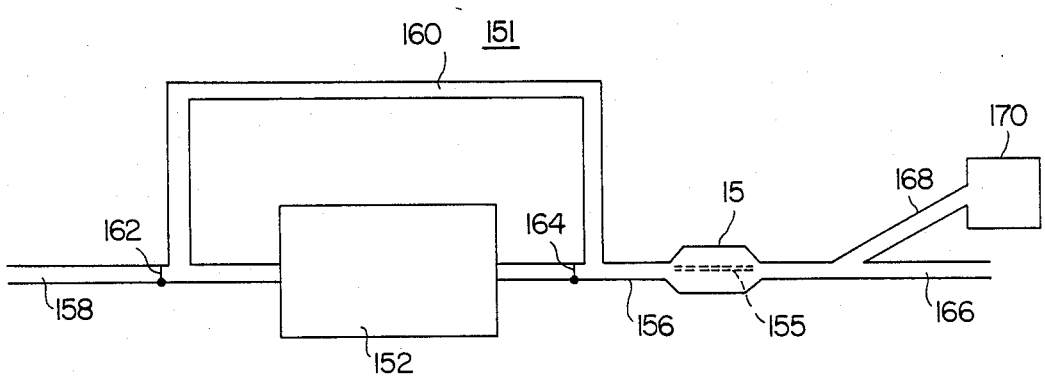
FIG. 4A is a schematic illustration of an alternative embodiment of the present invention employing the filter having an unobstructed passage shown in FIGS. 1A and 2A.
Figure 5:
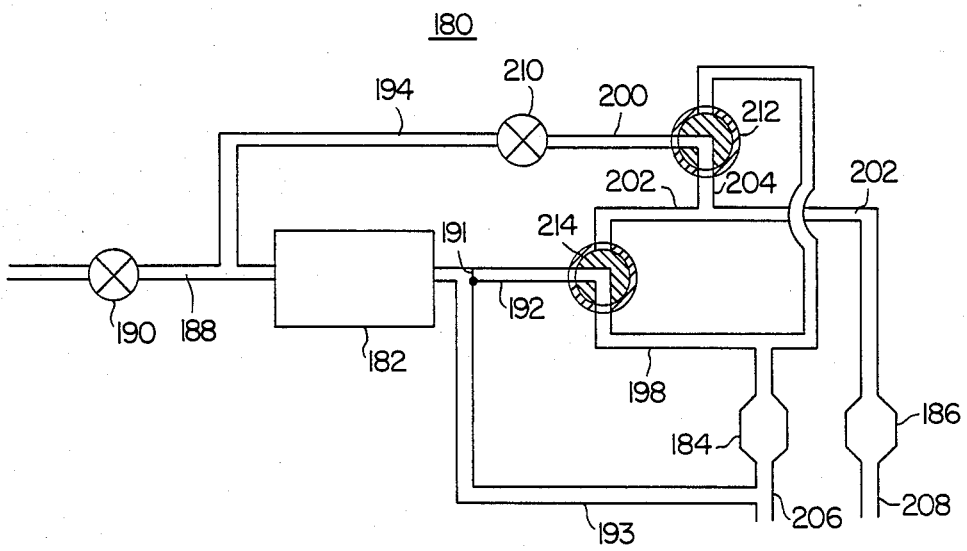
FIG. 5 is a schematic illustration of still another alternative embodiment of the invention using the filter bypass in which two filter zones are employed.
Figure 5A:
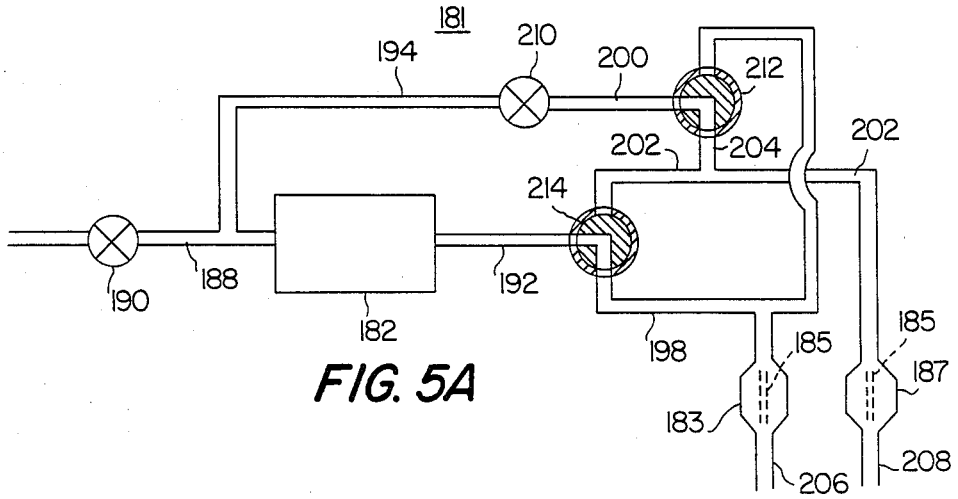
FIG. 5A is a schematic illustration of still another alternative embodiment of the invention using the filter having an unobstructed passage shown in FIGS. 1A and 2A.

In the open filter embodiment (i.e., one having at least one unobstructed passage therethrough as shown in FIG. 3A, 4A, or 5A), regeneration is effected in the same manner described above utilizing a pulse of backflush fluid through the filter unit in a direction opposite to that of the exhaust flow. The intensity or duration of the pulse may require adjustment to compensate for that volume of air which passes back through the unobstructed passage in the filter. This increase is easily calculated by one skilled in the art based upon the design configurations of the exhaust system.

The necessity for this increase in either volume or pressure may be eliminated altogether by installing a one-way valve (not shown) at the downstream face 30 of the filter so that when the pulse is generated opposite the direction of exhaust flow, the force of the pulse causes the one-way valve to close and forces the pulse to travel through channels 36 and thus regenerate the filter.

Pulsed backflushing fluid flow is suitably generated in any convenient manner which lends itself to utilization in the particular environment to which the invention is applied. Preliminarily, it is important to note that, while ambient air presents a convenient and highly useful backflushing fluid, the fluid is not necessarily limited to same. Alternatively, the fluid is suitably any one which can be passed through the filter material so as to dislodge trapped particles, and the presence of which does not otherwise interfere with or detrimentally affect the operation of the engine system. Oxygen, or an inert gas such as nitrogen, is an example of a suitable alternative fluid. (Of course, as will be apparent from the following, if a backflushing fluid not containing oxygen is used to dislodge the particles and transport [by means of entrainment] the particles back to the engine, then the engine is advantageously supplied with oxygen from another source in order that combustion be optimized.)

In an especially advantageous embodiment of the invention, the backflush fluid pulse is generated by inducing a vacuum condition, in the exhaust system on the upstream side of the trap, and then effecting a sudden release of backflush fluid into the vacuum or low pressure volume such that a sufficient mass of the backflush fluid rushes through the trap at high velocity (in a short time period) to dislodge trapped particles. An especially advantageous manner for accomplishing this is to employ the intake pull of the engine to draw down the pressure on the upstream side of the trap or filter unit. A valve in the exhaust system is actuated, and moved into the open position, in response to the attainment of a suitably low pressure; the valve's opening causes ambient air or other backflushing fluid to be drawn through the filter unit or trap in a direction opposite to that of the exhaust flow (the exhaust flow has of course been interrupted during this backflushing cycle) by the low pressure conditions on the upstream side of the filter unit or trap. Periodically, for example after every 3 to 50 pulses, a purging valve is opened immediately after the pulse has dislodged and entrained the particulate collected on the filter. This valve directs the particulate-laden exhaust either directly out of the system or is positioned to allow the exhaust to pass through the engine and then intercept it and carry it out of the system before the particulate is allowed to become reembedded in the filter element.

Alternatively, the backflush fluid pulse can be a burst or surge of pressurized fluid, for instance compressed gas (illustratively, air). The pulse is acceptably drawn from a pressurized container or other suitable source; conveniently compressed air drawn from the hydraulic or turbocharging system of a diesel-powered vehicle will do. The compressed gas pulse is injected into the exhaust system on the downstream side of the filter unit or trap so as to flow through the trap in a direction which is the reverse of that taken by the exhaust flow during normal filtering operations. Again, the compressed gas pulse is injected into the system during interruption of normal exhaust flow. The compressed gas pulse must be of sufficient mass and traveling at sufficient velocity to dislodge the particles trapped in the filter unit and convey it out of the exhaust system.

With the foregoing examples in mind, it is readily appreciable to the skilled artisan that any other suitable manner of drawing or forcing pulsed backflush fluid through the trap in a direction opposite to that taken by the exhaust flow can be utilized, the principal criteria of selection being only that the means employed is sufficient to dislodge trapped particles and it does not unduly interfere with the engine's operation.

In addition to providing a means for dislodging trapped particles from the filter unit for purposes of cleaning same, it is necessary in accordance with the present invention to transport those particles back to the diesel engine for incineration of the combustible particulate therein. This is typically accomplished by entraining the particles in a fluid stream conducted through a line of the exhaust system leading to the engine's air intake port. After initial dislodgment, the dislodged particles are in very short order brought under the influence of the flow of the aforementioned fluid stream. That flow must be sufficient to maintain "flotation," that is, keep the particles free from recapture by the trap or filter unit until they leave the unit. It must also be sufficient to keep them from depositing in the lines and valves. Recapture is disadvantageous in that it lowers the efficiency of the regeneration operation during the cleaning cycle.

In an advantageous refinement of the present invention the backflush fluid pulse employed to dislodge trapped solid particulate matter is also utilized as an entrainment vehicle, i.e. a carrier, for the dislodged particulate matter in order to transport same back to the diesel engine. Typically, the backflush fluid pulse is air, the oxygen component of which is sufficient, upon reaching the engine along with the particles entrained in the air, to enable the incineration (oxidation) of those particles.

Yet another embodiment suitable for commercial application utilizes a closed filter and separate filter bypass as illustrated in FIG. 3. A diesel engine 130 is connected to trap 132 by line 134. Intake line 136 leads from the ambient atmosphere to engine 130, to provide ambient air for combustion within the engine. Line 138 is connected to line 134 and to line 136 to provide an alternate flow path around the engine. Line 139 is connected to line 134 and provides a purging bypass around the trap 132. Valve 140 is positioned across line 136, and is movable from an open position permitting flow through the line, to a closed position interrupting flow. Valve 142 is positioned across line 134, and is movable between an open position permitting flow through -he line and a closed position preventing such flow. Valve 143 is positioned across line 134 and is movable from an open position (shown) permitting exhaust flow to bypass the trap and a closed position allowing normal filtered operation. Line 138 is connected to line 136 between valve 140 and the engine, and is connected to line 134 between valve 142 an the trap 132. The pressure drop across trap 132 is monitored by a conventional sensor (not shown for the sake of simplicity). When the pressure drop across the exhaust filter reaches a predetermined value, valves 140 and 142—which are normally open to permit intake flow to the engine and transportation of the exhaust stream to the trap for filtration—are closed simultaneously. This can be accomplished by actuating a solenoid on each valve by means of a differential pressure switch placed across the filter. Valve 144 is positioned across line 138, and is movable between an open position permitting flow through line 138 and a closed position preventing flow. When valves 140 and 142 are closed the engine quickly reduces the pressure in the volume of line between the engine and valve 144. During this time, exhaust from the engine is accumulated in the volume of line between the engine and valve 142.

Valve 144 is an automatic valve that opens when the pressure differential across it reaches a predetermined value. When valve 144 opens in response to the drawing down of pressure by the engine in line 138 (valve 144 opens very quickly) ambient air flows through line 146, trap 132, line 134 line 138 and line 136, and eventually to the engine, in a direction opposite that of normal exhaust flow. This surge of gas constitutes a pulsed backflushing of trap 132, which surge carries particles dislodged from the trap back to the engine for incineration.

Valves 140 and 142 open in response to valve 144's automatic opening, after a suitable delay. Valve 144 automatically closes after the pressure differential across it is removed, and the system is restored to its original condition. The entire cleaning sequence is completed in less than one second, and preferably less than 0.25 second. Indeed, regeneration periods of no more than one second, and preferably no more than 0.25 second, are advantageously employed in many other embodiments of the invention also.

Figure 7:
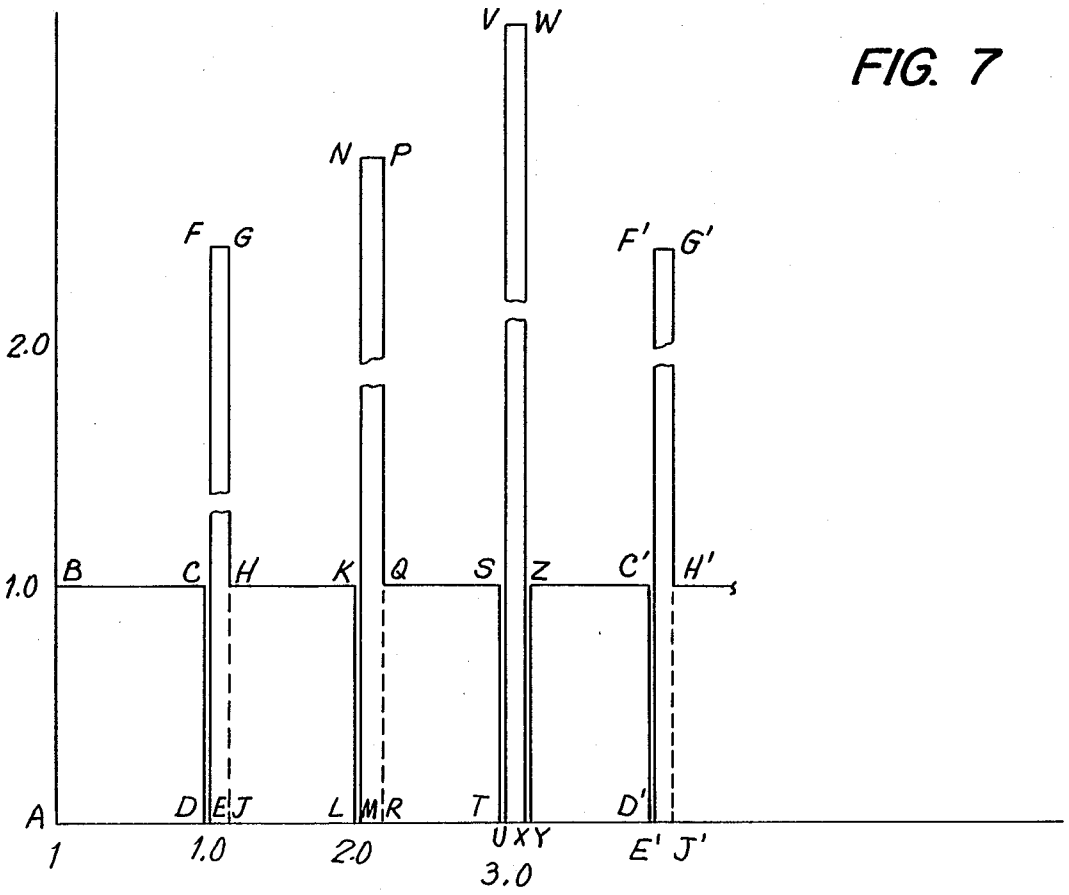
FIG. 7 is a step curve showing the relative quantity of solid noncombustible particulate entering the filter as a factor of time.

At designated intervals, usually after between 3 and 50 pulses, a valve 143 is actuated to allow the entrained particulate to be carried out of the system. This valve is positioned immediately upstream of the filter 134 as shown in FIG. 3 at 143 to bleed off the accumulated particulate prior to reintroduction into the engine. Ideally, this valve 143 is opened in timed sequence with the backflush fluid pulse so that the entrained noncombustible particulate is permitted to pass out of the exhaust system through line 139 and thus avoid becoming reentrapped on the filter means. The step curve shown in FIG. 7 shows this noncombustible solid particulate accumulation as a factor of time.

FIG. 3A depicts an alternate embodiment of another exhaust filtering system suitable for commercial application. Its operation is similar to that described with reference to FIG. 3 above. However, line 139 and valve 143 have been eliminated and a filter unit 135 having an unobstructed passage 137 (shown in phantom) thereon has been substituted for closed trap 132. In this embodiment, purging is accomplished by allowing a predetermined percentage of the total exhaust flow to bypass the filtering elements within trap 135 and pass out of the exhaust system through unobstructed passage 137. This percentage of exhaust flow allowed to bypass the filter is known in the art as the "bleed fraction"—i.e., that portion of the total flow which is allowed to bleed off from the system. This bleed fraction is determined by the size, shape and number of unobstructed passages contained in the filtering elements. The bleed fraction should ideally be chosen such that a workable balance is achieved between particulate emission from the engine and particulate buildup within the engine. The bleed fraction is preferably between 0.01 to 0.70 but can, if desired, be from 0.01 to 0.99. In present day applications, the range would be between 0.05 and 0.15 to be readily adaptable to existing equipment and space limitations.

Figure 6A:
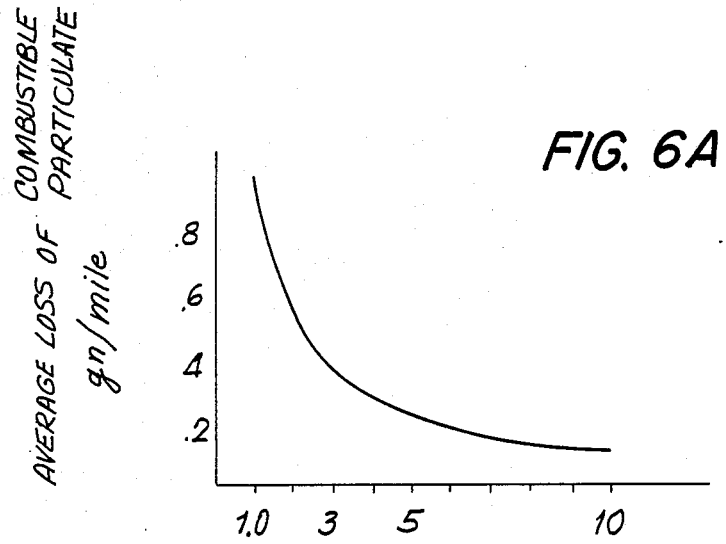
FIGS. 6A–6C are curves indicating the variation in system characteristics as passage size increases.
Figure 6B:
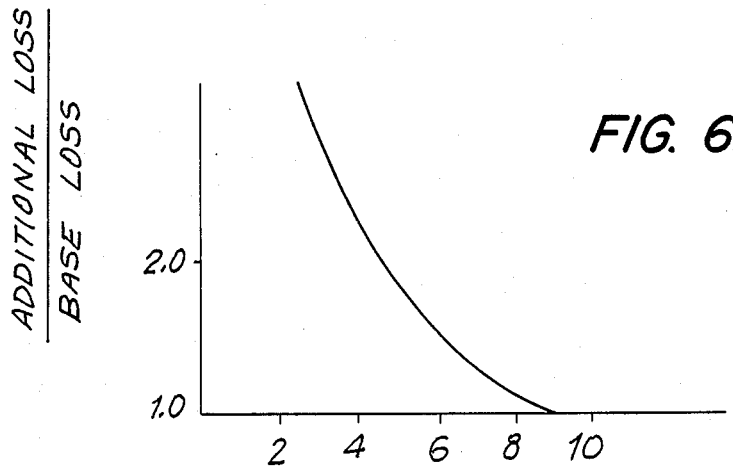

In operation, engine 130 produces exhaust gas containing solid particulate composed of approximately 90% combustible solids (usually in the form of soot) and approximately 10% noncombustible solids. These percentages may vary depending on the condition of the engine. They may also be varied significantly by tuning and adjusting the engine to more efficiently burn the combustible portion of the particulate. This tuning can result in the formation of exhaust gas having a particulate composition which is 60% combustible and 40% noncombustible. A portion of the particulates, depending on the bleed fraction, passes out of the system through passage 137 while the balance becomes entrapped in the filter 135. When the filter is backflushed by means of a fluid pulse, both the combustible and noncombustible particulate is entrained and transported back to the engine where a large portion of the accumulated combustible material is burned. The noncombustible particulate, however, passes back through the exhaust line 134 where, again depending on the bleed fraction, a portion of the entrained noncombustible particulate passes out of the system through 137 and the balance becomes reentrapped in filter 135. One skilled in the art of filtered flows having bleed offs will readily appreciate that over a period of time a steady state will be achieved wherein the amount of noncombustible particulate contained in the volume of exhaust gas which bleeds off will equal the amount being produced by the engine. The hyperbolic curves shown in FIGS. 6A and 6B show how the average loss of combustible particulate varies with the frequency of the purge pulse. These figures will be discussed in detail below.

Embodiments similar to those in FIGS. 3 and 3A are illustrated in FIGS. 4 and 4A. In FIG. 4, a closed filter system 150 includes diesel engine 152 connected to trap 154 by line 156. Intake line 158 leads from the ambient atmosphere to engine 152, to provide ambient air for combustion within the engine. Line 160 is connected to line 156 and to line 158 to provide an alternate flow path around the engine. Line 155 is connected to line 156 to provide a bypass for trap 154. Valve 162 is positioned across line 158, and is movable from an open position permitting flow through the line, to a closed position interrupting flow. Valve 164 is positioned across line 156, and is movable between an open position permitting flow through the line and a closed position preventing such flow. Valve 163 is positioned across line 156 and is movable between an open position allowing exhaust gas to flow through line 155 and out of the system and a closed position directing the flow back to trap 154. Line 160 is connected to line 158 between valve 162 and engine 152, and is connected to line 156 between valve 164 and trap 154. The pressure drop across trap 154 is monitored by a conventional sensor (not shown for the sake of simplicity). When the pressure drop across trap 154 reaches a predetermined value, valves 162 and 164—which are normally open to permit intake flow to the engine and transportation of the exhaust stream to the trap for filtration—are closed simultaneously. This can be accomplished by actuating a solenoid on each valve by means of a differential pressure switch placed across the filter. After a suitable but short delay a pulse of compressed air is released from source 170 and injected through line 168 into line 166, through trap 154 and lines 156, 160 and 158 into engine 152. This surge of air constitutes a pulsed backflushing of trap 154, which surge carries particles dislodged from the trap back to the engine for incineration. During this time, exhaust from the engine is accumulated in the volume of line between the engine and valve 164.

Valves 162 and 164 open a suitable time after injection of the compressed air pulse. The entire cleaning sequence is completed in less than one second, and preferably less than 0.10 second.

Again, as in the embodiment shown in FIG. 3, a valve 163 positioned in the exhaust line is opened immediately following every third to fiftieth pulse so that the particulate-laden exhaust can be bled off and conducted out of the system through line 155 before becoming reentrapped in the filter.

FIG. 4A illustrates an alternate embodiment of FIG. 3A indicated generally at 151. The operation of this system is analogous except that rather than using a backflush fluid pulse generated by the engine, it is supplied by compressed air from source 170 and injected through line 168 into line 166, through trap 153 containing a filter element having a passage 155 therethrough and through lines 156, 160, and 158 into engine 152.

A still further embodiment of the invention is illustrated in FIG. 5. A filtered system 180 includes diesel engine 182 connected alternately to trap 184 by lines 192 and 198 and to trap 186 by lines 192 and 202. Intake line 188 leads from the ambient atmosphere to engine 182, to provide ambient air for combustion within the engine; valve 190 is positioned across line 188 and is movable between open and closed states permitting and interrupting flow, respectively. Line 194 is connected to line 188 and to line 202 to provide an alternate flow path around the engine. Line 192 connects with valve 214, and is movable to direct flow into either line 198 or 202 while closing off flow to the other. Line 200 connects to valve 212, which is movable to direct flow from either line 198 or 204 into line 200, and to close off flow from the line not selected. Line 194 is connected to line 188 between valve 190 and the engine. The pressure drop across traps 184 and 186 is monitored by conventional sensors (not shown for the sake of simplicity). Line 193 is connected to line 192 between engine 182 and valve 214 and line 206 just beyond filter 184. Valve 191 provides access to line 193 and is movable between an open position wherein exhaust gas is directed past filters 184 and 186 and a closed position wherein the exhaust flow is filtered by either 184 or 186.

Assume trap 184 is filtering exhaust. When the pressure drop across trap 184 reaches a predetermined value, valves 214 and 212—which have been oriented to permit transportation of the exhaust stream to trap 184 for filtration and drawing of air through trap 186, lines 202, 204, 200 and 194, and line 188 back to the engine—are moved simultaneously. The system is then set so that exhaust flows through lines 192 and 202 to trap 186, and then into line 208 to the atmosphere while flow from the atmosphere through trap 184, lines 198, 200 and 194, and line 188 back to the engine is permitted. Periodically valve 190 is closed. Valve 210 is positioned across line 200, and is movable between an open position permitting flow through line 200 and a closed position preventing flow. When valve 190 is closed the engine quickly reduces the pressure in the volume of line between the engine and valve 210, which is normally closed.

Valve 210 is an automatic valve that opens when the pressure differential across it reaches a predetermined value. When valve 210 opens in response to the drawing down of pressure by the engine in line 194 (valve 210 opens very quickly) ambient air flows through line 206, trap 184, line 198, line 200 and line 194, and eventually (through line 188) to the engine. This surge of gas constitutes a pulsed backflushing of trap 184, which surge carries particles dislodged from the trap back to the engine for incineration.

When valve 190 is opened, valve 210 automatically closes after the pressure differential across it is removed, and the system is restored to its initial condition. The entire cleaning sequence is completed in less than one second, and preferably less than 0.25 seconds. In some embodiments each trap is cleaned by a plurality of such sequences. When trap 186 needs regeneration, valves 212 and 214 are operated to direct exhaust to trap 184 and permit backflushing of trap 186 in like manner. Periodically, the exhaust system is purged of noncombustible solid particulate through line 193. This usually is timed to occur after every third to fiftieth pulse. The purge step can be accomplished no matter which line is being filtered or regenerated. For example, if purging is to be carried out while trap 184 is filtering and trap 186 is being cleaned, valves 213 and 214 would be in the position shown in FIG. 5. The backflush fluid pulse is directed through filter 186 to entrain the particulate, which is carried via lines 202, 204, 200, 194 and 188 back to the engine. The combustible component of the exhaust is destroyed in engine 182 and the noncombustible component passes out of the engine to line 198. Valve 191 is opened and the exhaust gases carrying the noncombustible particulate are routed out of the system through line 193 to line 206. It can be readily appreciated from the foregoing example that numerous alternative systems containing a plurality of filter zones are configurable depending on the needs of the practitioner and his environmental constraints.

FIG. 5A illustrates an alternate embodiment 181 of the system shown in FIG. 5 wherein the line 193 and valve 191 are replaced by passages 185 in filter traps 183 and 187. The operation of the system is substantially the same as that described above in relation to FIGS. 3A and 4A. The passages 185 are advantageously sized such that the level of noncombustible particulate found within the system 181 reaches a steady state level below the level at which appreciable damage can be done to the engine.

Figure 6C:
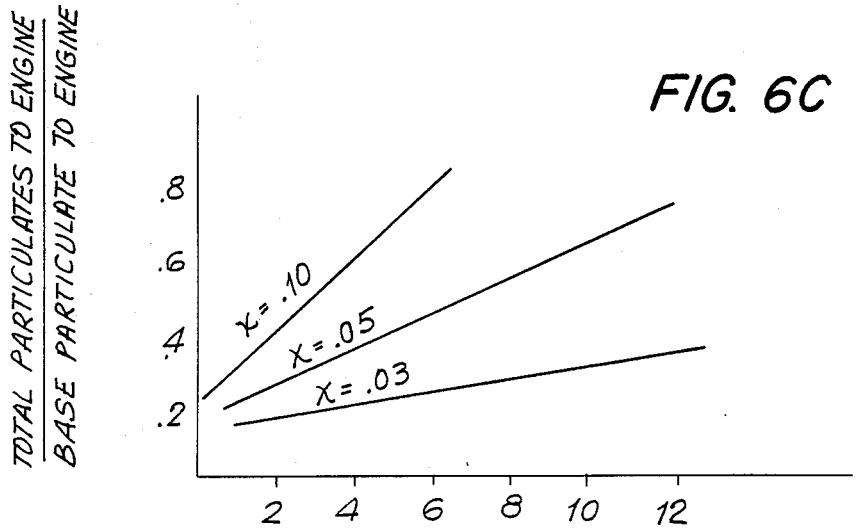

FIGS. 6A–C illustrate curves for determining appropriate purge times. These figures assume, for generating the basis of the curves, that the engine generates 1.0 gm/mile of combustible particulate and x gm/mile of noncombustible particulate. The assumed value of the filtration fraction (f) is 0.90. This indicates that 0.10 of the particulate is not recovered by the filter.

The curve shown in FIG. 6A is a plot showing the loss of combustible particulate vs. the frequency of the purge pulse. Thus, for example, where the system is purged every 10 pulses the average loss of combustible particulates would be 0.20 gm/mile. Similarly, from the plot, if the system is purged every 3 pulses, the average loss of combustible particulates would be 0.40 gm/mile.

FIG. 6B is a plot indicating the additional loss of combustible particulate relative to the loss with the purge pulse (i.e., the base loss). As indicated, where the system is purged every 6 pulses, the additional loss of combustible material is 1.5 times the base loss and where the system is allowed to purge every 9 pulses, the additional loss is equal to the base loss.

FIG. 6C shows 3 separate plots of the additional loss of particulates recycled to the engine as a function of purge frequency. Each plot represents a different engine production of noncombustible particulate (i.e., $x=0.10$; $x=0.05$; $x=0.03$). Thus, for example, where the engine is producing 1.0 gm/mile of combustible particulate and 0.10 gm/mile of noncombustible particulate, it is possible to determine the number of pulses necessary between purges to achieve a given ratio of particulate to the engine as a function of base particulates to the engine (this figure will usually be determined by the government or EPA regulations) simply by following the appropriate plot to the x-axis value.

FIG. 7 is a plot showing the accumulation of noncombustible particulate over a period of three (3) pulse cycles with a purge bypass occurring after the third pulse. This figure is offered merely by way of illustration and is generated by assuming an ideal filter (i.e. a filter having 100% efficiency) and constant, uniform production of noncombustible particulate. The curve indicates the relative quantity of noncombustible particulate entering the filter zone relative to time.

During the first cycle, (relative time from 0 to 1) noncombustible particulate enters the filter at a steady rate. At the end of this first cycle, an amount of noncombustible particulate equal in quantity to the area of the rectangle ABCD has been trapped at the filter. During the blowback pulse, i.e. the time between D and E, no material enters the filter. At time E, however, the filter comes back on stream at which time it encounters a burst of noncombustible particulates of very short duration EJ. This burst is relatively short but substantial in amount since the area of the rectangle EFGJ must be equal to the area ABCD. Because the base EJ is infinitesimal, the elevation EF far exceeds unity.

The rate at which the filter "sees" noncombustible particulate quickly drops to the steady level corresponding to point H and continues at that rate until the next blowback pulse. The area JHKL is the amount of new noncombustible particulate accumulated. Once again, the rate of material fed to the filter drops to zero during the blowback pulse LM. At point M, the filter again encounters a burst of duration MR. The area MNPR is twice the area EFGJ because the accumulation represents two time periods. Thus, if the duration MR is equal to EJ, then MN is twice EF.

The same arguments apply to the third cycle, with UVWX being three times EFGJ and UV three times EF. At the end of this pulse, however, the bypass is activated and this material is diverted from recapture by the filter as the rate of noncombustible particulate drops to zero at point X. The cycle begins again at point Y.

The terms and expressions which have been employed are used as terms of description and not of limitation, and there is no intention in the use of such terms and expressions of excluding any equivalents of the features shown and described or portions thereof, its being recognized that various modifications are possible within the scope of the invention. Thus, it can readily be appreciated that the invention is not limited to dislodgment of particles from the filter unit by means of a pulse of backflushing fluid. Rather, any mechanical wave which is of sufficient power to effect dislodgment of solid particulate matter trapped in the filter unit, and which can feasibly be employed in the particular application to which the invention is put, is suitable for practice of the invention. For instance, in certain embodiments of the invention the particles are acceptably dislodged from the filter unit by a sonic wave generated by appropriate conventional apparatus. The principal and basic criterion for such mechanical waves are that the filter unit must be subjected to a wave of sufficient power, that is of sufficiently high energy passing by any point within the filter unit in a selected unit of time, to dislodge the trapped particulate material. Waves which fulfill this requirement are suitable.

In accordance with the foregoing, an improved method and apparatus are provided which enable direct, simple, relatively inexpensive and efficient filtration of diesel engine exhaust to incinerate or remove solid particulate matter therefrom. More specifically, the present method and apparatus embodiments result in a reduction of solid particulate emission levels in diesel engine exhaust to an insignificant level, i.e., filtering out of 90% or more of the particulate while effectively avoiding the undesirable accumulation of solid noncombustible particulate matter within the engine. Thus, the present invention obviates the need for deliberate suppression of engine power, or reliance on other disadvantageous conventional filtration techniques, in order to reduce solid particulate exhaust emission. The attainment of effective filtration of solid particulate matter from diesel engine exhaust along with a significanlly increased utilization of the diesel engine's potential power output is a substantial advance in the art.

What is claimed is:

1. In a method for decreasing the emission of soot from a diesel engine which includes the steps of passing the engine's exhaust flow through at least a part of filter means to trap solid particulate matter contained initially in the exhaust, thereby to remove said matter from said exhaust flow, periodically interrupting the exhaust flow through at least said part of the filter means, passing, during said interruption, at least one backflush fluid pulse through at least said part of the filter means thereby to dislodge from the filter means, and entrain, said solid particulate matter, and transporting said dislodged solid particulate matter to the intake of said engine so that a portion of said matter can be combusted in the engine, the improvement comprising the further step of periodically purging the accumulated, noncombustible solid particulate from said engine every 3 to 50 pulses.

2. In a method for decreasing the emission of soot from diesel engine which includes the steps of passing the engine's exhaust flow through at least a part of filter means having at least one filter element in a single filter zone, said filter element being selected from the group consisting of ceramic honeycomb filter structure, sintered porous metal material, metal mesh, ceramic foam and granular bed to trap solid matter from said exhaust flow, interrupting said exhaust flow through at least said part of the filter means for up to one second, passing, during said interruption, at least one backflush fluid pulse, said pulse being generated by the intake pull of the diesel engine, through at least said part of the filter means thereby to dislodge from the filter means and entrain, said solid particulate matter, and transporting said dislodged particulate matter to the intake of said engine so that a portion of said matter can be combusted in the engine, the improvement comprising the further step of substantially continuously purging a portion of the accumulated, noncombustible solid particulate from said engine.

3. An improved method as defined in claim 2 wherein the step of continuously purging a portion of the accumulated, noncombustible solid particulate is accomplished by permitting a portion of the exhaust to pass unfiltered out of the engine.

4. An improved method as defined in claim 3 wherein from 1% to 70% of the exhaust is permitted to bypass said filter means.

5. An improved method as defined in claim 3 wherein a portion of the exhaust is permitted to pass unobstructed through said filter means.

6. An improved method as defined in claim 5 wherein from 1% to 70% of the exhaust is permitted to pass unobstructed through said filter means.

7. An improved method as defined in claim 2 wherein from 5% to 20% of the exhaust is permitted to pass unfiltered out of the engine.

8. In a diesel engine, improved apparatus for decreasing exhaust emissions having filter means positioned to intercept the engine's exhaust flow and trap solid particulate matter contained initially in the exhaust when that exhaust flows through at least part of said exhaust flow, means for periodically interrupting the exhaust flow through at least said part of the filter means, means for passing, during said interruption, at least one backflush fluid pulse through at least said part of the filter means thereby to dislodge said particulate matter from the filter means, and entrain said solid particulate matter, means for transporting said dislodged solid particulate matter to said engine so that said matter can be combusted in the engine, wherein the improvement comprises filter bypass means for periodically removing any accumulated noncombustible solid particulate from said engine, said filter bypass means comprising a normally closed valving means which is opened after between 3 and 50 pulses, said valving means being opened after a pulse and before said particulate has become again trapped on said filter means.

9. An improved apparatus as recited in claim 8 wherein said filter bypass means is opened in sequence with said pulse to allow the entrained solid particulate to be purged from the engine.

10. An improved apparatus as defined in claim 8 wherein said filter bypass means is opened for up to 1 second to allow purging of the accumulated particulate.

11. In a diesel engine, improved apparatus for decreasing exhaust emissions having a filter means selected from the group consisting of ceramic honeycomb filter structure, sintered porous metal material, metal mesh, ceramic fiber, ceramic foam and granular bed, said filter means having a single filter zone which is positioned to intercept the exhaust flow of said engine and which traps solid particulate matter contained in the exhaust flow of said engine when that exhaust flows through said filter zone, thereby to remove said matter from the exhaust flow, means for interrupting the exhaust flow through said filter zone for up to one second, means for passing, during said interruption, a backflush fluid pulse through said filter zone thereby to dislodge from the filter means, and entrain, said solid particulate matter, said backflush fluid pulse being generated by the intake pull of the diesel engine, means for transporting said dislodged solid particulate matter to the engine so that said matter can be combusted in the engine, wherein the improvement comprises purge means for substantially continuously removing any accumulated noncombustible solid particulate from said engine.

12. An improved apparatus as in claim 11 wherein said purge means comprises at least one unobstructed passage through said filter means.

13. An improved apparatus as in claim 12 wherein said passage is sized relative to said filter means to permit a bleed fraction of from 0.01 to 0.70.

14. An improved apparatus as defined in claim 12 wherein said passage is sized relative to said filter means to permit from 5% to 15% of said exhaust to avoid said filter means.

15. An improved apparatus as defined in claim 12 wherein said unobstructed passage allows a total of from approximately 1% to 70% of the exhaust to pass through said filter means.

* * * * *